US011389990B2

(12) United States Patent
Pope

(10) Patent No.: US 11,389,990 B2
(45) Date of Patent: Jul. 19, 2022

(54) CONCRETE MIXING MACHINE

(71) Applicant: Donald A. Pope, Ocilla, GA (US)

(72) Inventor: Donald A. Pope, Ocilla, GA (US)

( * ) Notice: Subject to any disclaimer, the term of this patent is extended or adjusted under 35 U.S.C. 154(b) by 0 days.

(21) Appl. No.: 16/847,301

(22) Filed: Apr. 13, 2020

(65) Prior Publication Data

US 2020/0406500 A1 Dec. 31, 2020

Related U.S. Application Data

(60) Provisional application No. 62/832,840, filed on Apr. 11, 2019.

(51) Int. Cl.

| | |
|---|---|
| ***B28C 5/12*** | (2006.01) |
| ***B28C 5/16*** | (2006.01) |
| ***B28C 7/00*** | (2006.01) |
| ***B28C 5/08*** | (2006.01) |

(52) U.S. Cl.

CPC ..... *B28C 5/1253* (2013.01); *B28C 5/085* (2013.01); *B28C 5/0818* (2013.01); *B28C 5/0856* (2013.01); *B28C 5/16* (2013.01); *B28C 7/0007* (2013.01)

(58) Field of Classification Search

CPC ..... B28C 5/1253; B28C 5/16; B28C 7/0007; B28C 5/0818; B28C 5/085; B28C 5/0856; B28C 5/0887; B01F 7/22; B01F 7/00633; B01F 13/0037; B01F 27/191; B01F 27/91; B01F 33/5021

See application file for complete search history.

(56) References Cited

U.S. PATENT DOCUMENTS

| | | | | |
|---|---|---|---|---|
| 3,967,815 | A * | 7/1976 | Backus | B28C 5/003 366/64 |
| 4,692,028 | A * | 9/1987 | Schave | E01C 19/45 366/13 |
| 4,830,505 | A * | 5/1989 | Dunton | B01F 3/1221 366/136 |
| 6,666,573 | B2 * | 12/2003 | Grassi | B01F 5/0473 366/150.1 |
| 7,048,430 | B2 | 5/2006 | Birningham, Sr. et al. | |
| 2020/0406500 | A1 * | 12/2020 | Pope | B01F 13/0037 |
| 2021/0310331 | A1 * | 10/2021 | Martin | B28C 5/16 |

* cited by examiner

*Primary Examiner* — Charles Cooley
(74) *Attorney, Agent, or Firm* — Brian D. Bellamy

(57) ABSTRACT

A concrete mixing machine for indoor preparation of fluid concrete for disposition as flooring. The concrete mixing machine includes a mixer tank capable of mixing of twenty-three bags of concrete concurrently. Mixing propellers inside of the mixer tank attach to a shaft, whereby a hydraulic propeller drive motor rotationally moves the shaft, and the mixing propellers mix the concrete. The concrete mixing machine produces a large batch of concrete, and the concrete mixing machine moves and deposits the concrete for application using a flow control mechanism with a flow control mixer attached to the mixer tank that regulates concrete flow through a valve and chute and synchronizes with a flow control drive-wheel. The concrete mixing machine is hydraulically operated and self-propelled. The concrete mixing machine does not emit gases harmful to indoor air quality and thus is environmentally friendly.

10 Claims, 11 Drawing Sheets

CONCRETE MIXING MACHINE

PRIORITY CLAIM

This application claims benefit of U.S. provisional patent application No. 62/832,840 filed on Apr. 11, 2019.

TECHNICAL FIELD

The present invention relates to a concrete mixer and, particularly, to a high-capacity hydraulically operated concrete mixing machine for indoor use.

BACKGROUND

The object of the present invention is to provide a concrete mixer that is an environment-friendly concrete mixing machine, which improves efficiency installing concrete flooring indoors and prevents indoor air pollution.

Currently, workers mix concrete for application indoors using small vats. Operators add 2-3 bags of concrete mix, add needed fluid or chemicals creating a slurry, and manually stir and turn the moistened combination until mixed. The process is slow and labor-intensive. A need exists to increase the quantity and efficiency of mixing the ingredients of concrete material and depositing concrete based flooring indoors while meeting environmental requirements. Thus, a need exists for a new concrete mixer.

SUMMARY OF THE INVENTION

According to the embodiments illustrated herein, there is provided a concrete mixing machine, also referred to as a concrete mixer, for generating concrete for application in one or more areas. The concrete mixing machine comprises a machine with a frame comprising a mid-frame section. In an embodiment, the mid-frame section has a lattice platform and provides structural support for components of the concrete mixer. The concrete mixing machine further comprises an engine compartment that houses an engine mounted on the lattice platform. In an embodiment, the engine comprises a propane gas container, a vacuum generator, and the engine is attached to a hydraulic drive pump driven by the engine. In an embodiment, the engine mounts on a mount-support across the frame. The concrete mixing machine further comprises a plurality of hoses attached to the engine, and the plurality of hoses comprises a hydraulic fluid in-hose, hydraulic fluid out-hose, and backflow in recycle-hose for fluid.

The concrete mixing machine further comprises a mixing assembly comprising a mixer tank, a flow control mechanism, and a removable grate. In an embodiment, the removable grate attaches on top of the mixer tank. In an embodiment, the flow control mechanism comprises a flow control mixer attached to the mixer tank, and a flow control drive-wheel. In an embodiment, the flow control mixer regulates the amount of concrete exiting through a valve and a concrete disbursing chute attached to the mixer tank. In an embodiment, the valve is located in bottom of the mixer tank and opens to permit passage and flow of the fluid concrete to the concrete disbursing chute. In an embodiment, the concrete disbursing chute is connected at bottom of the mixer tank, and the concrete disbursing chute is utilized to direct the slurry concrete in one or more areas of application. In an embodiment, an operator configures the flow control drive-wheel on the mixer tank. The flow control drive-wheel regulates and controls the flow of concrete from the mixer tank to the concrete disbursing chute.

The concrete mixing machine further comprises a hydraulic system comprising a filter for hydraulic fluid, a battery, one or more hydraulic hoses, a catalytic muffler for exhaust, and an air filter. The concrete mixing machine further comprises a plurality of steering wheels configured to direct the movement of the concrete mixing machine. In an embodiment, the steering wheels connect to the frame. The concrete mixing machine further comprises a shaft disposed inside the mixer tank, wherein the shaft is attached to a plurality of mixing propellers. In an embodiment, a structural member on top of the mixer tank supports a propeller drive motor configured to rotationally move the shaft attached to the plurality of mixing propellers. The concrete mixing machine further comprises a hydraulic drive motor connected to the shaft disposed inside the mixer tank. In the configuration of an embodiment, the hydraulic drive motor rotationally moves the shaft attached to the plurality of mixing propellers.

In an embodiment, the disclosure herein describes a concrete mixing machine for indoor preparation of fluid concrete for disposition as flooring. The claimed limitations provide a concrete mixing machine capable of mixing of 23 bags of concrete concurrently. The concrete mixing machine produces a large batch of concrete material, and the concrete mixing machine moves and deposits the material for the application. The concrete mixing machine is hydraulically operated and self-propelled. The concrete mixing machine does not emit gases harmful to indoor air quality and thus is environmentally friendly.

These features and advantages of the present disclosure may be appreciated by reviewing the following description of the present disclosure, along with the accompanying figures wherein like reference numerals refer to like parts.

BRIEF DESCRIPTION OF DRAWINGS

The accompanying drawings illustrate the embodiments of systems, methods, and other aspects of the disclosure. Any person with ordinary skills in the art shall appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another and vice versa. Furthermore, the elements may not be drawn to scale.

The specification may describe various embodiments by the appended drawings that illustrate, not limit, the scope, wherein similar designations denote similar elements, and in which:

A concrete mixing machine comprises a support frame and hydraulic controls, an environmentally safe gas or electric power source, a mixer tank of 50-150-gallon capacity, and a dust control system disclosed. Further disclosed, the hydraulic controls operate mixing propellers, a system regulating concrete flow, and drive-wheel. The concrete mixing machine operates indoors without the emission of hazardous gas or dust.

Figure 1:
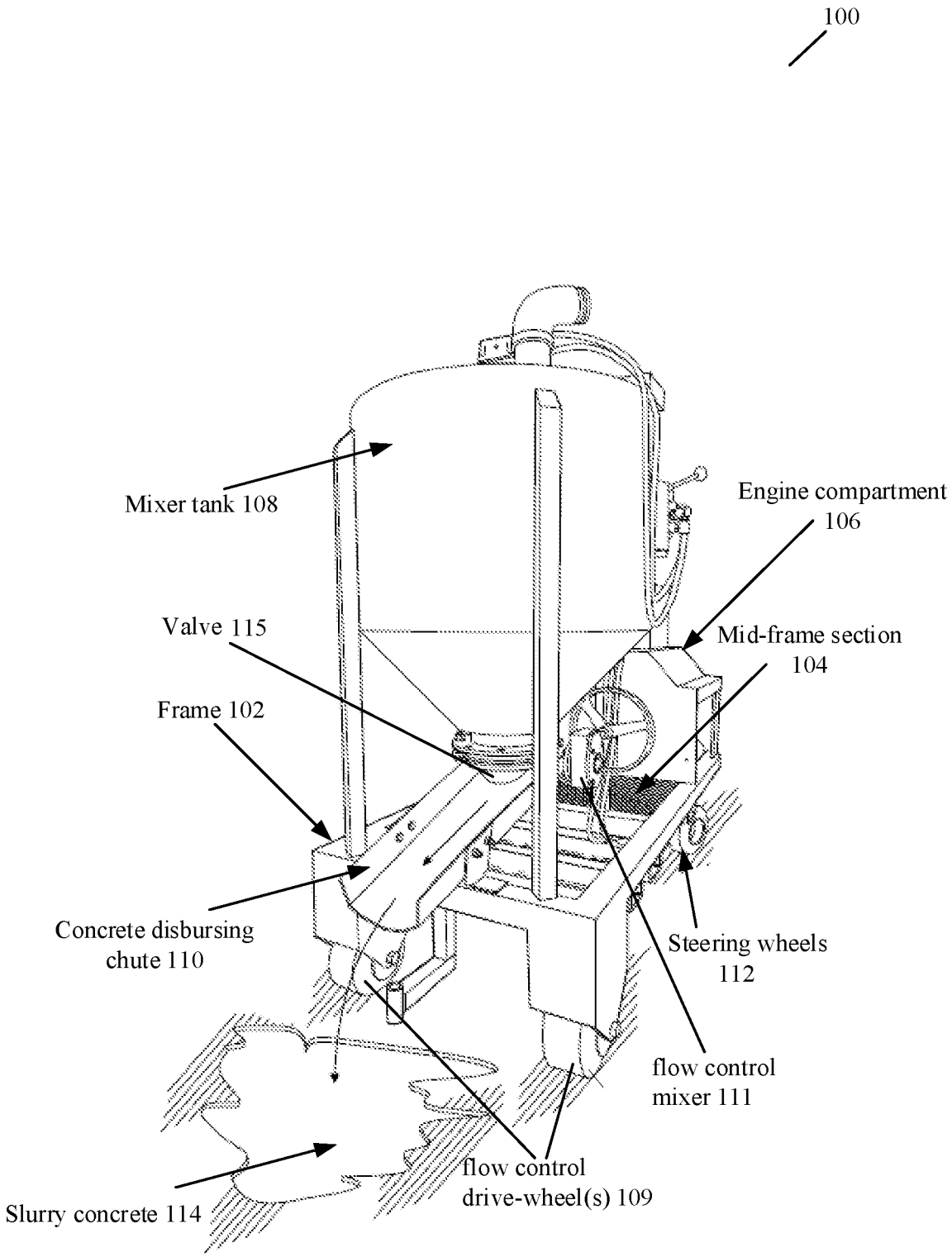

FIG. 1 is a perspective view of a concrete mixing machine according to a preferred embodiment of the present invention.

Figure 2:
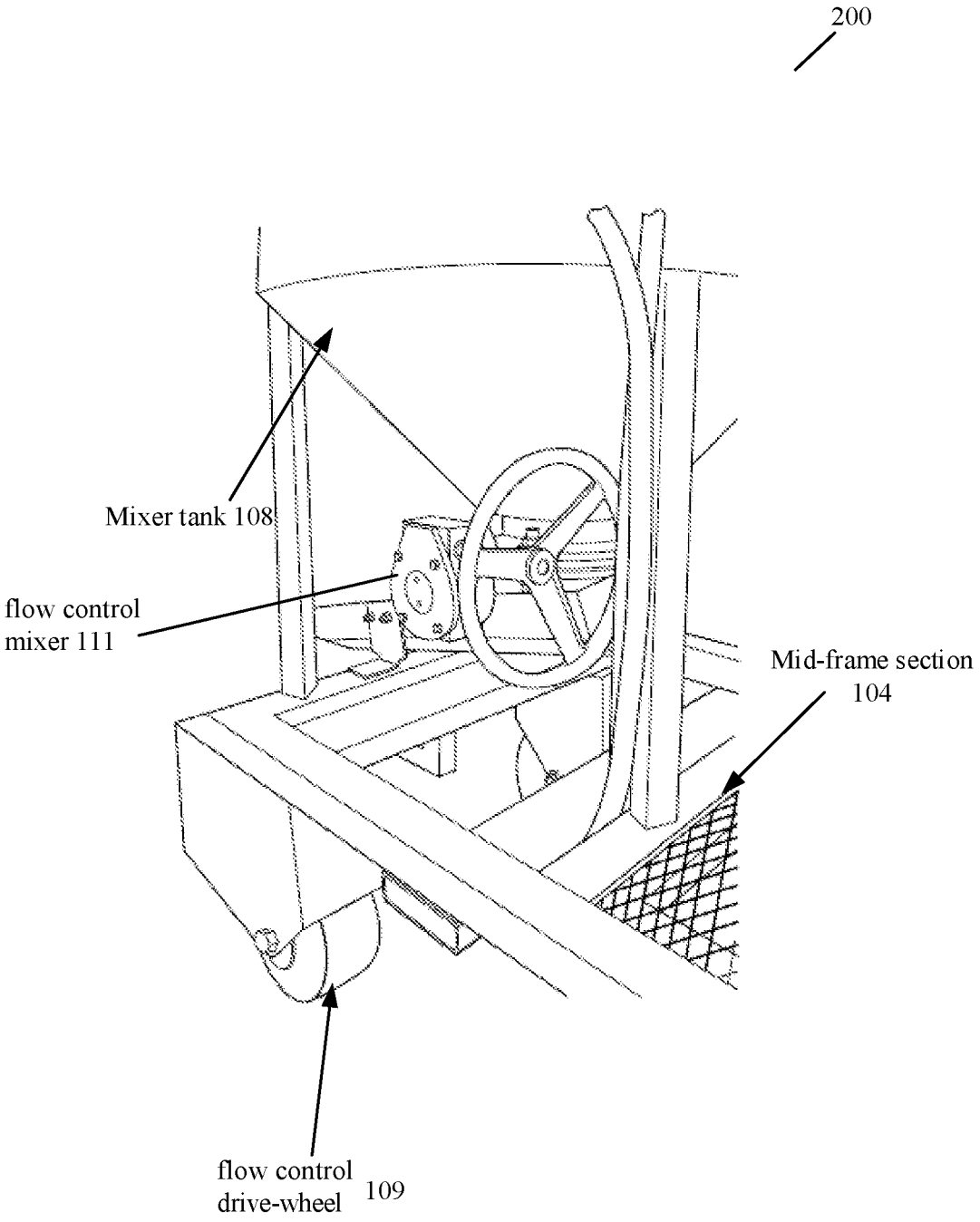

FIG. 2 is a partial perspective view of the concrete mixing machine of FIG. 1 showing a section including a mixer tank and a mid-section lattice platform.

Figure 3:
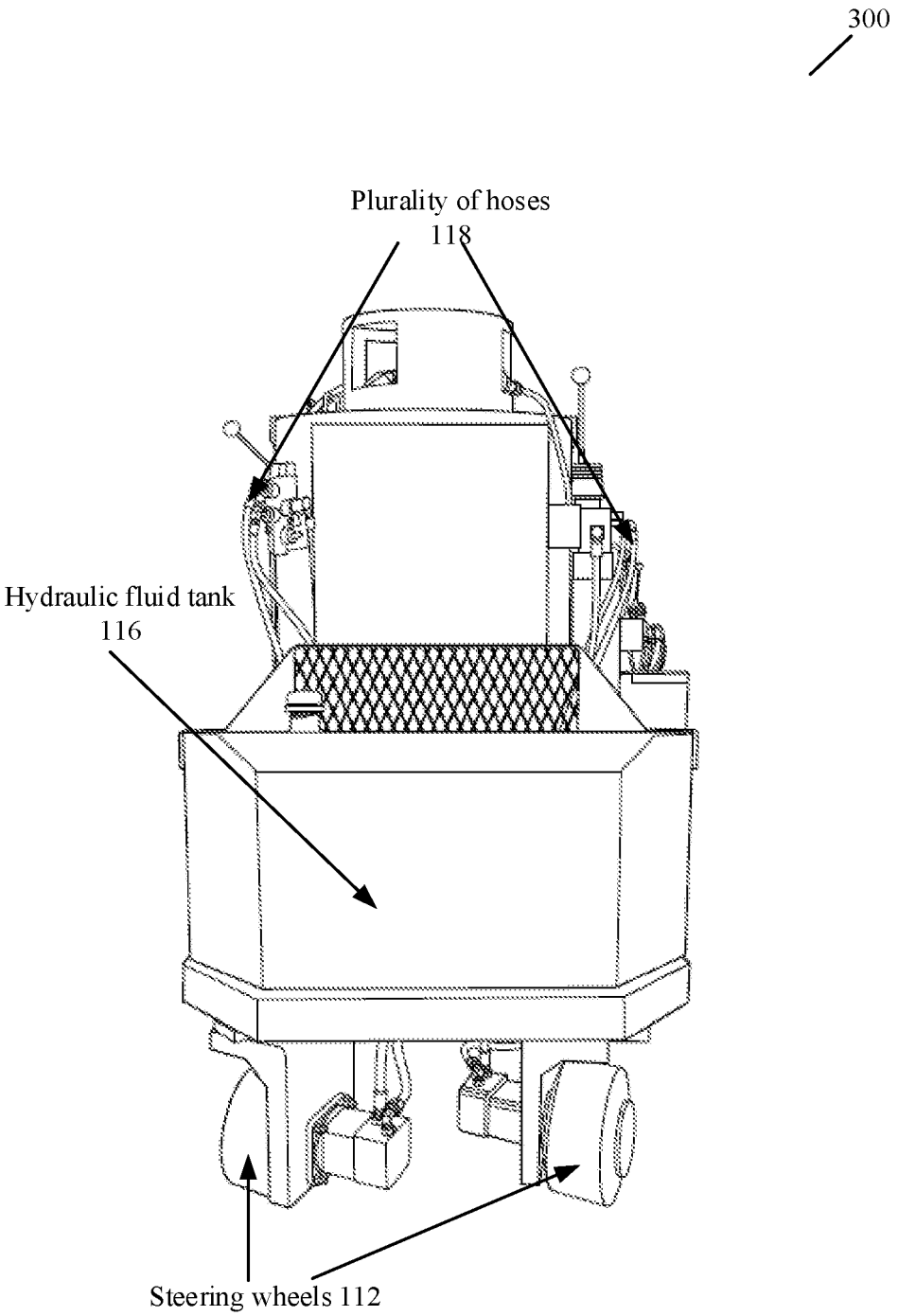

FIG. 3 is a front view of the concrete mixing machine of FIG. 1 showing the hydraulic fluid tank, steering wheels, and other aspects of the invention.

Figure 4:
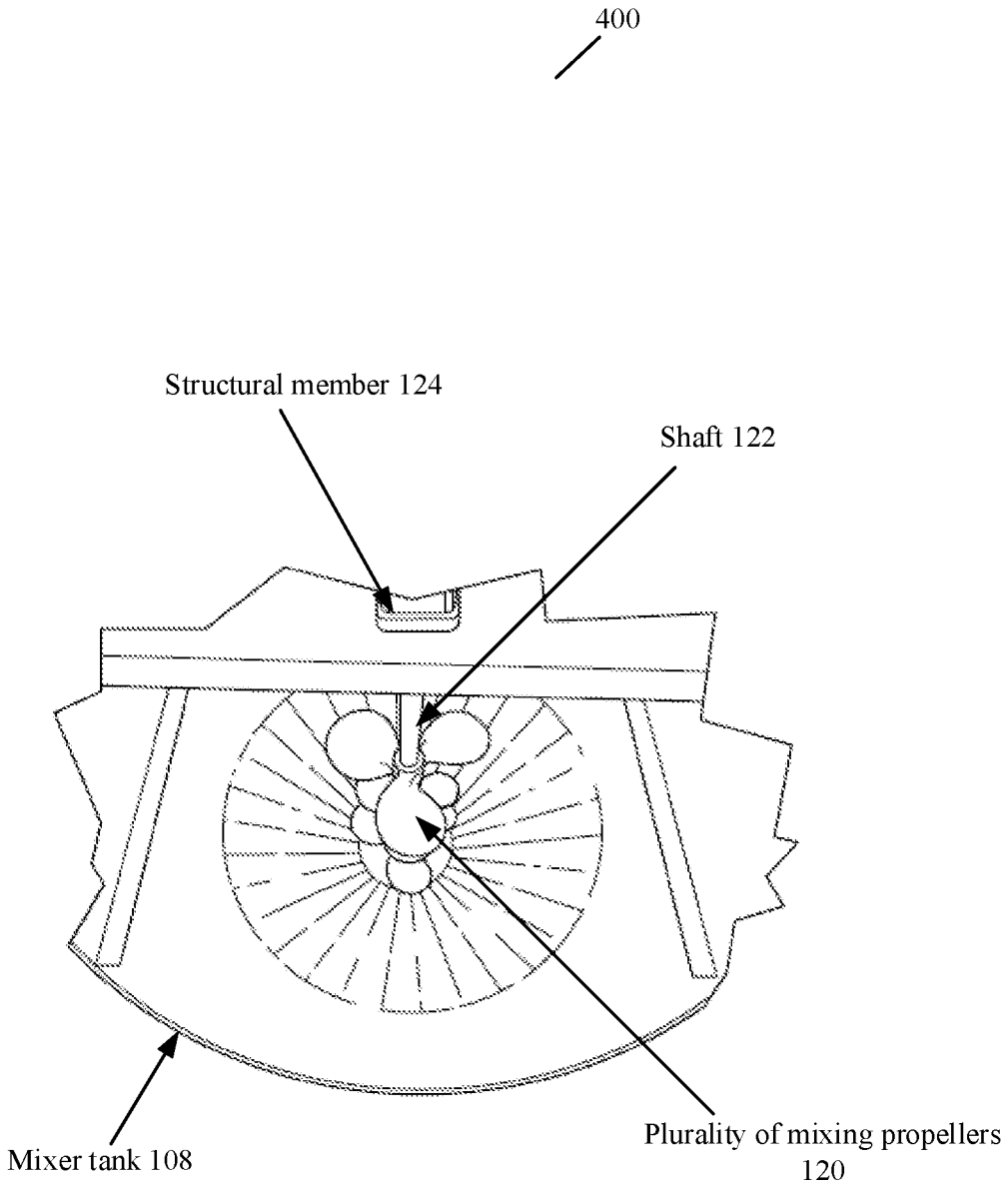

FIG. 4 is a partial view of the concrete mixing machine of FIG. 1 showing a section including the interior of a mixer tank and shaft with mixing propellers.

Figure 5:
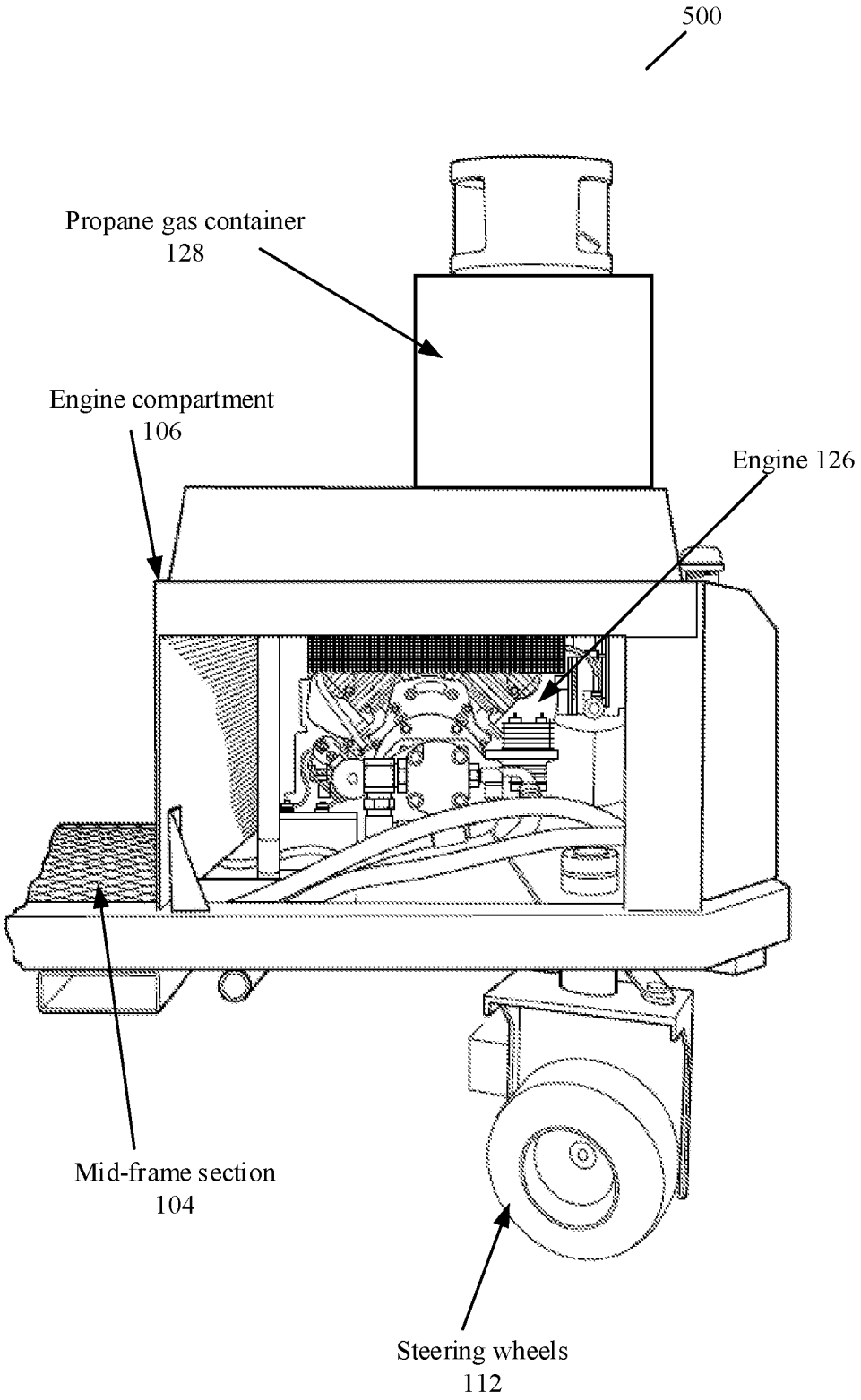

FIG. 5 is a partial right-side view of the concrete mixing machine of FIG. 1 showing an engine with propane gas container, wheels, vacuum, and mid-section lattice deck.

Figure 6:
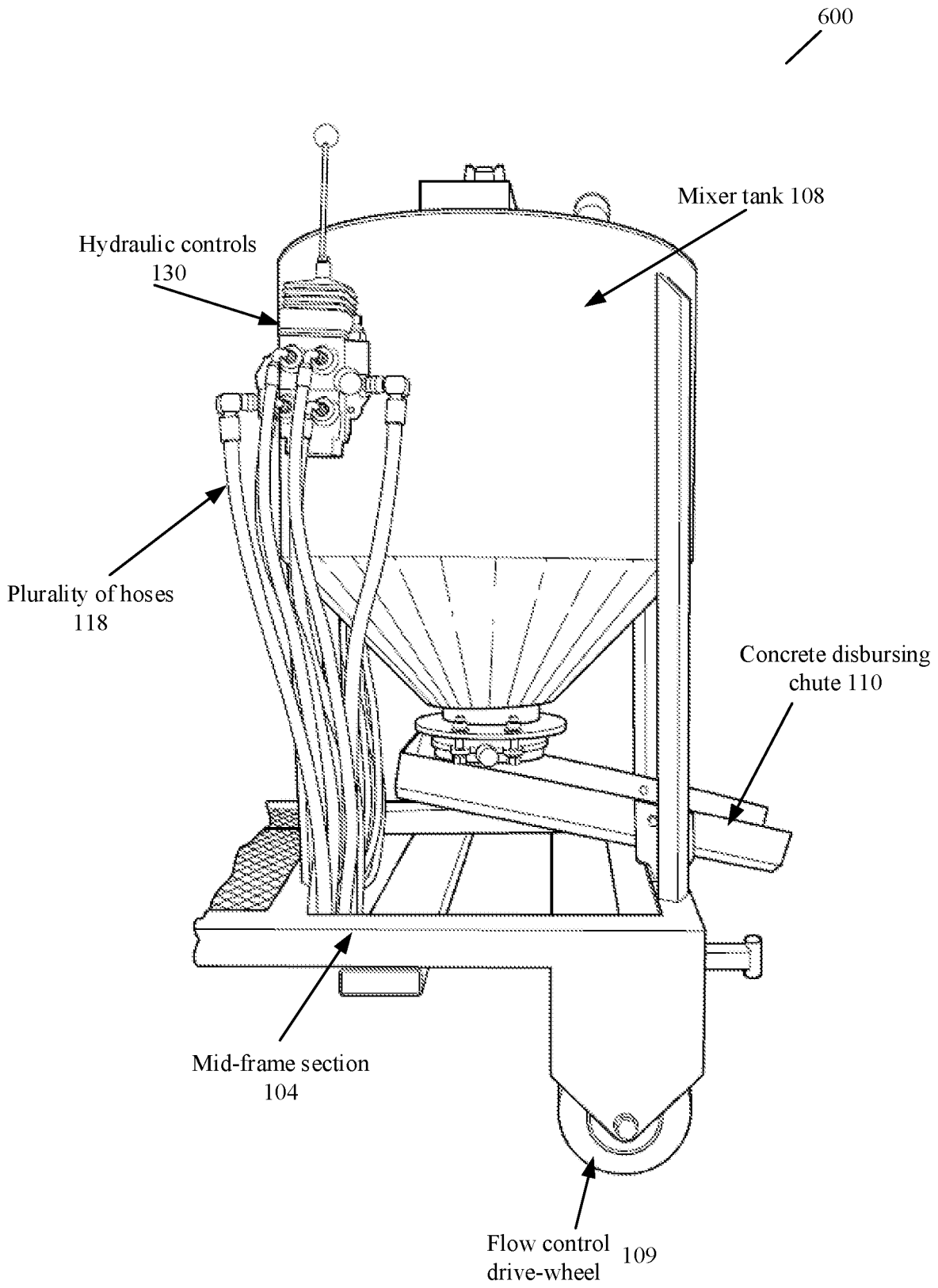

FIG. 6 is a partial left-side view of the concrete mixing machine of FIG. 1 showing a mixer tank, concrete disbursing chute, hydraulic controls, and mid-section lattice deck.

Figure 7:
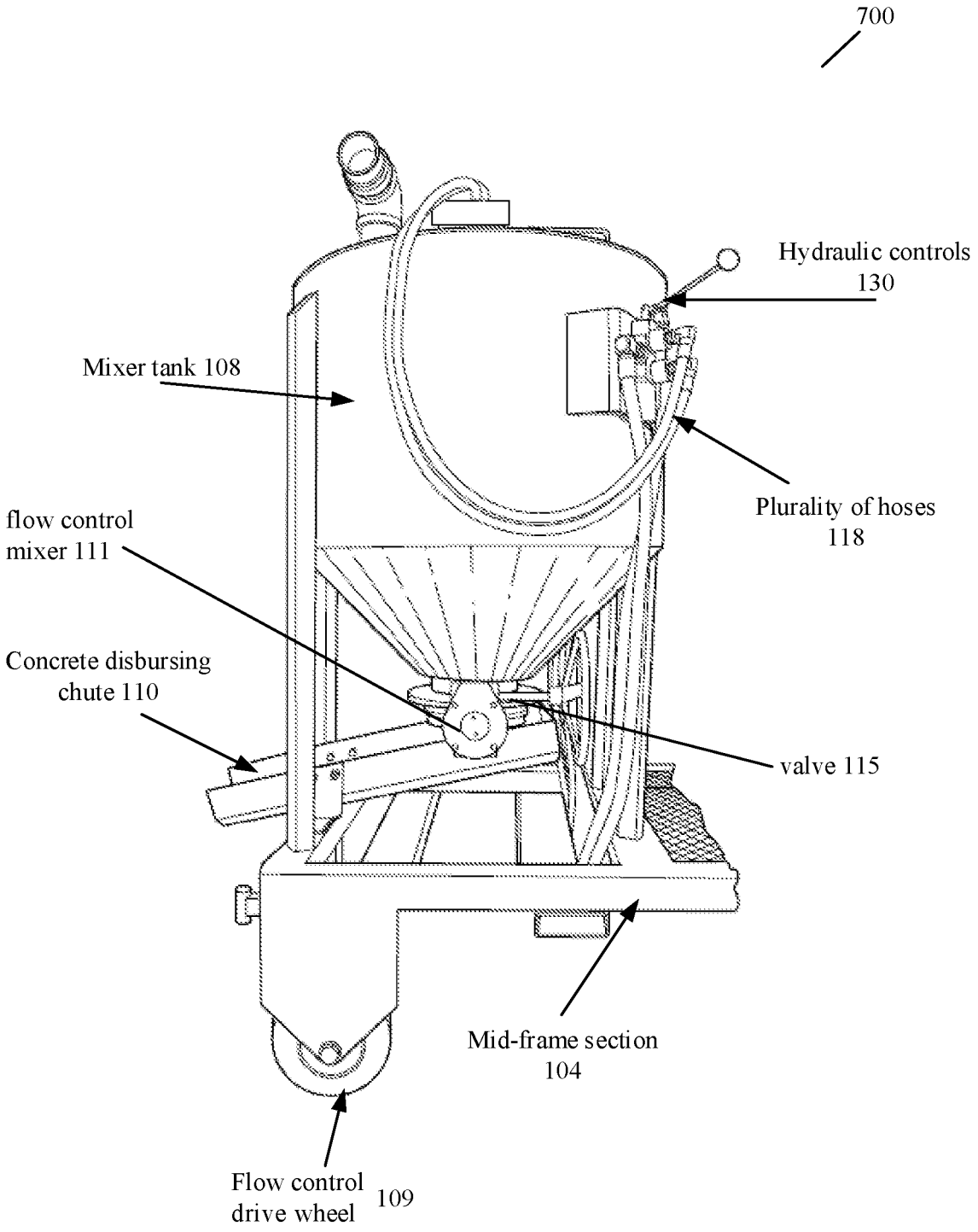

FIG. 7 is a partial right-side view of the concrete mixing machine of FIG. 1 showing a mixer tank, concrete disbursing chute, hydraulic controls, vacuum, and mid-section lattice deck.

Figure 8:
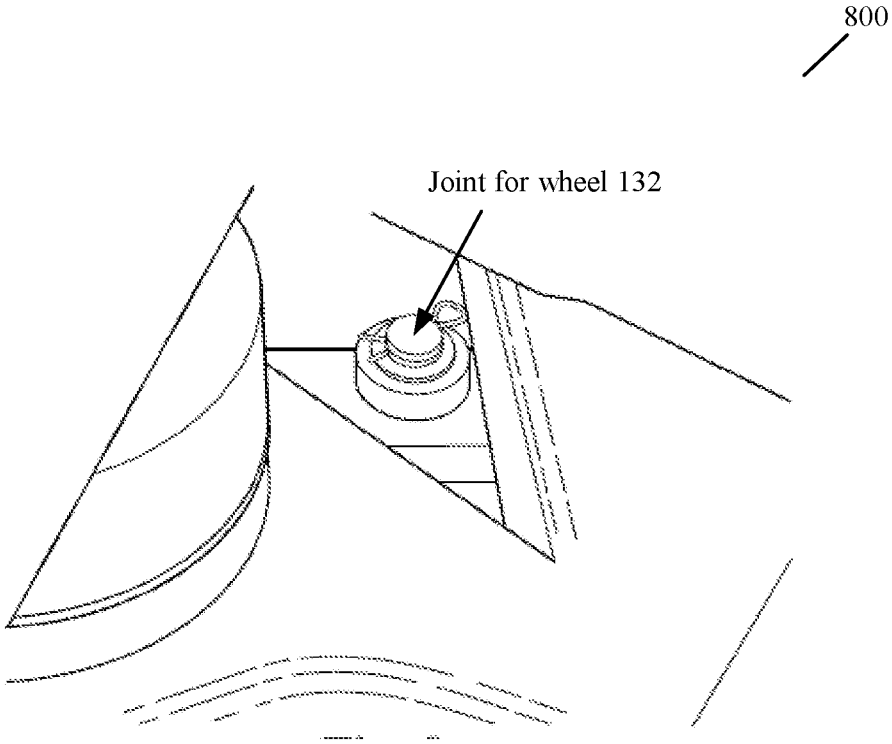

FIG. 8 is a partial perspective view of a joint for a swivel wheel of the concrete mixing machine of FIG. 1.

Figure 9:
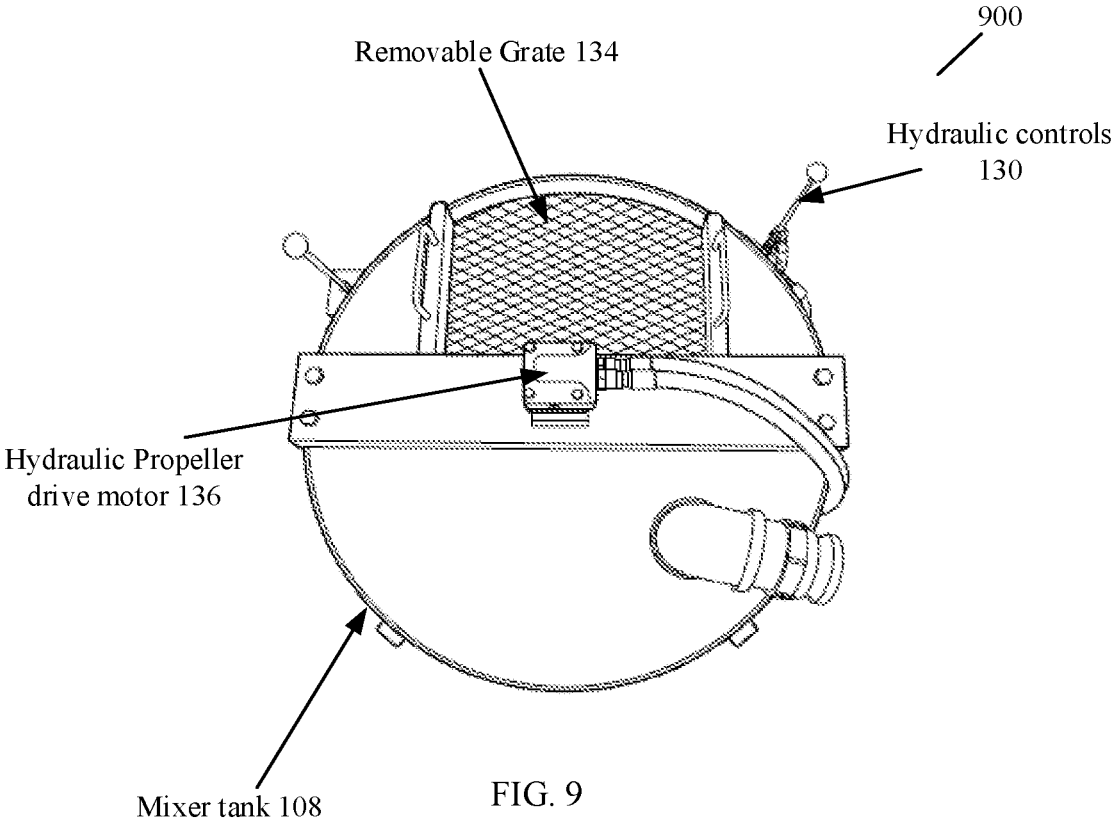

FIG. 9 is a partial top view of the concrete mixing machine of FIG. 1 showing a mixer tank, vacuum, hydraulic controls, a hydraulic drive motor for a mixer shaft, and a removable grate.

Figure 10:
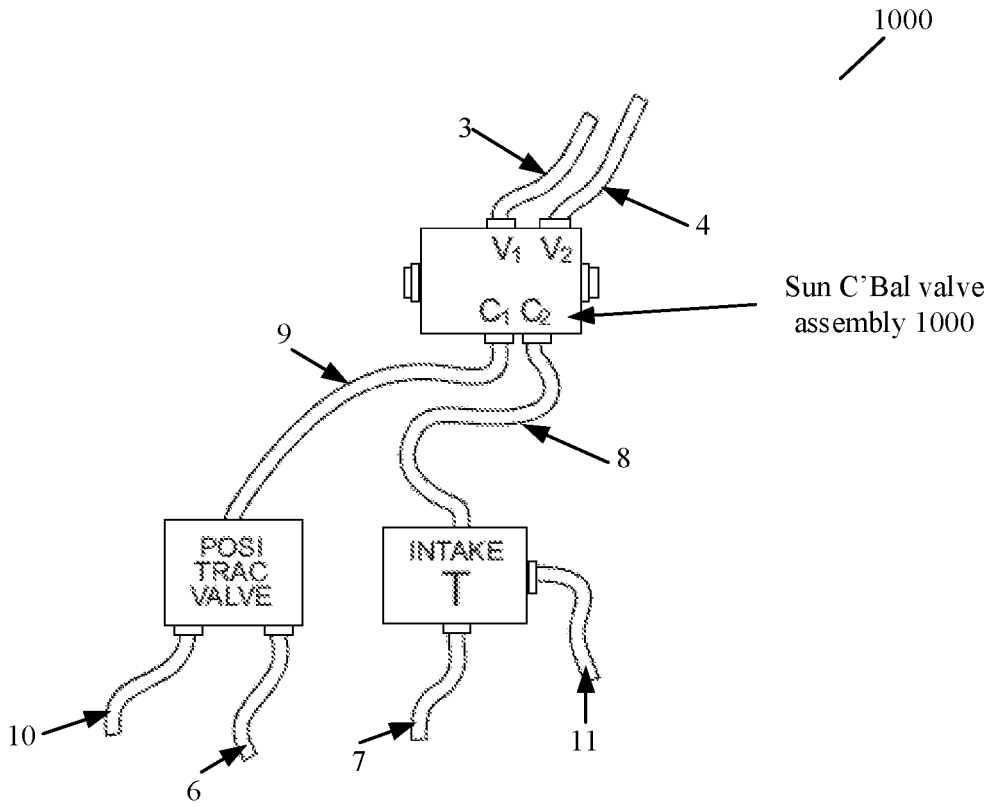

FIG. 10 is a partial schematic view of a hydraulic control system for the concrete mixing machine of FIG. 1.

Figure 11:
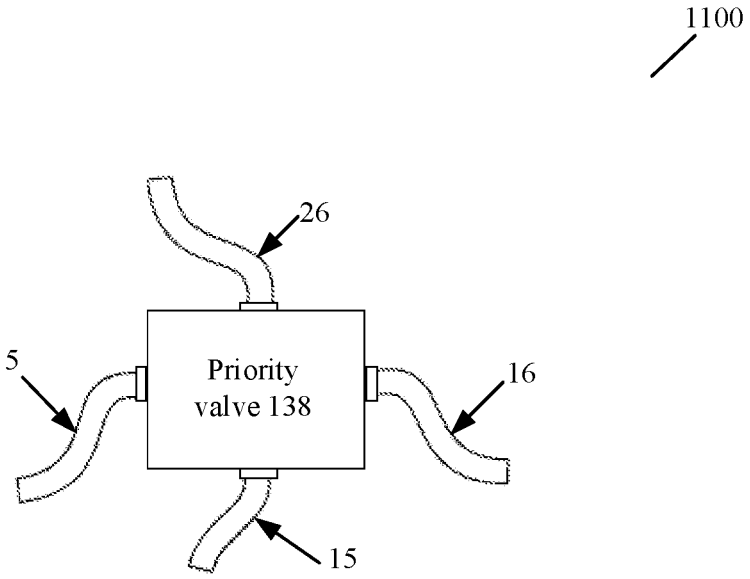

FIG. 11 is a partial schematic view of a priority valve of a hydraulic control system for the concrete mixing machine of FIG. 1.

Figure 12:
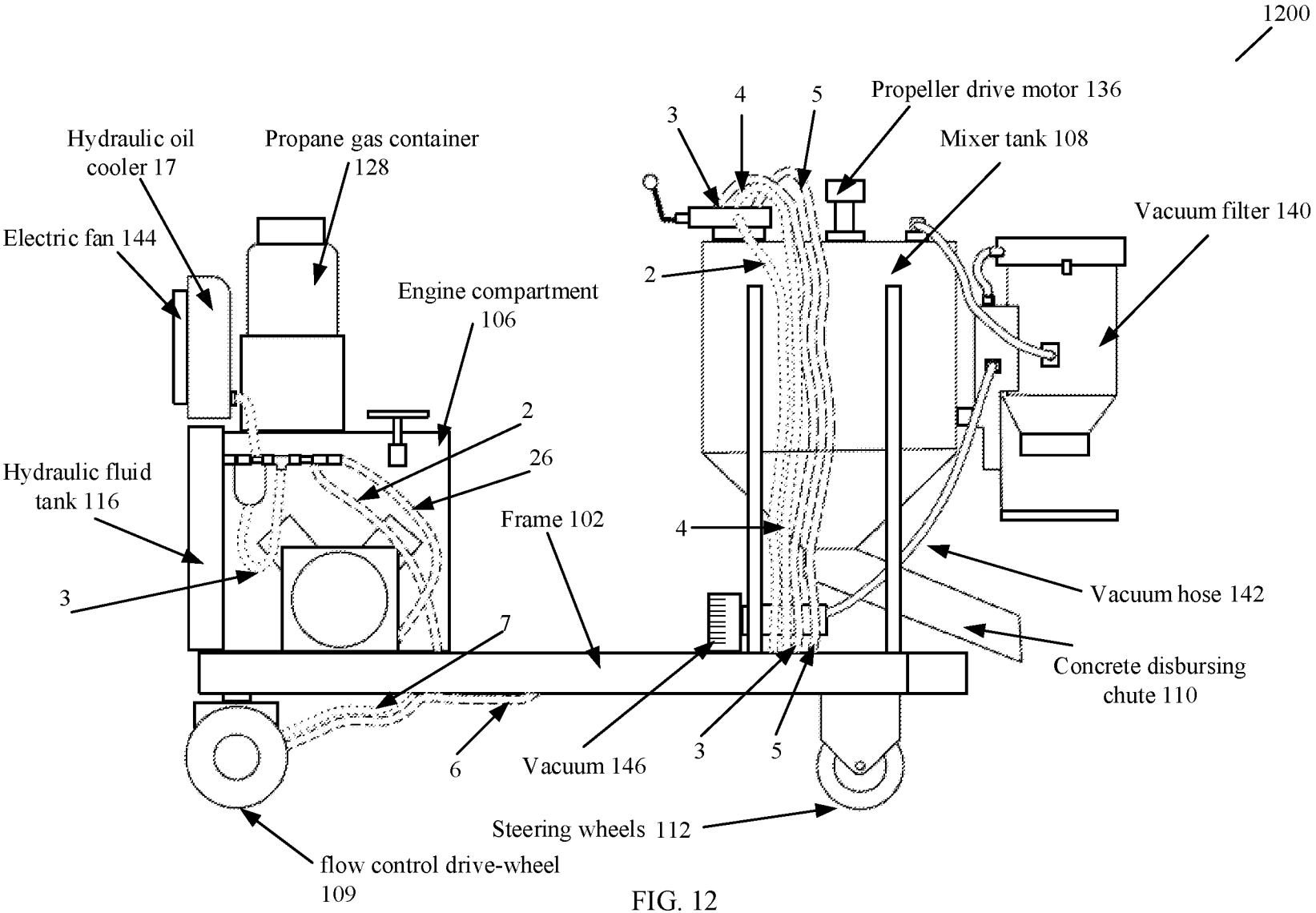

FIG. 12 is a right-side schematic view of a hydraulic control system for the concrete mixing machine of FIG. 1.

Figure 13:
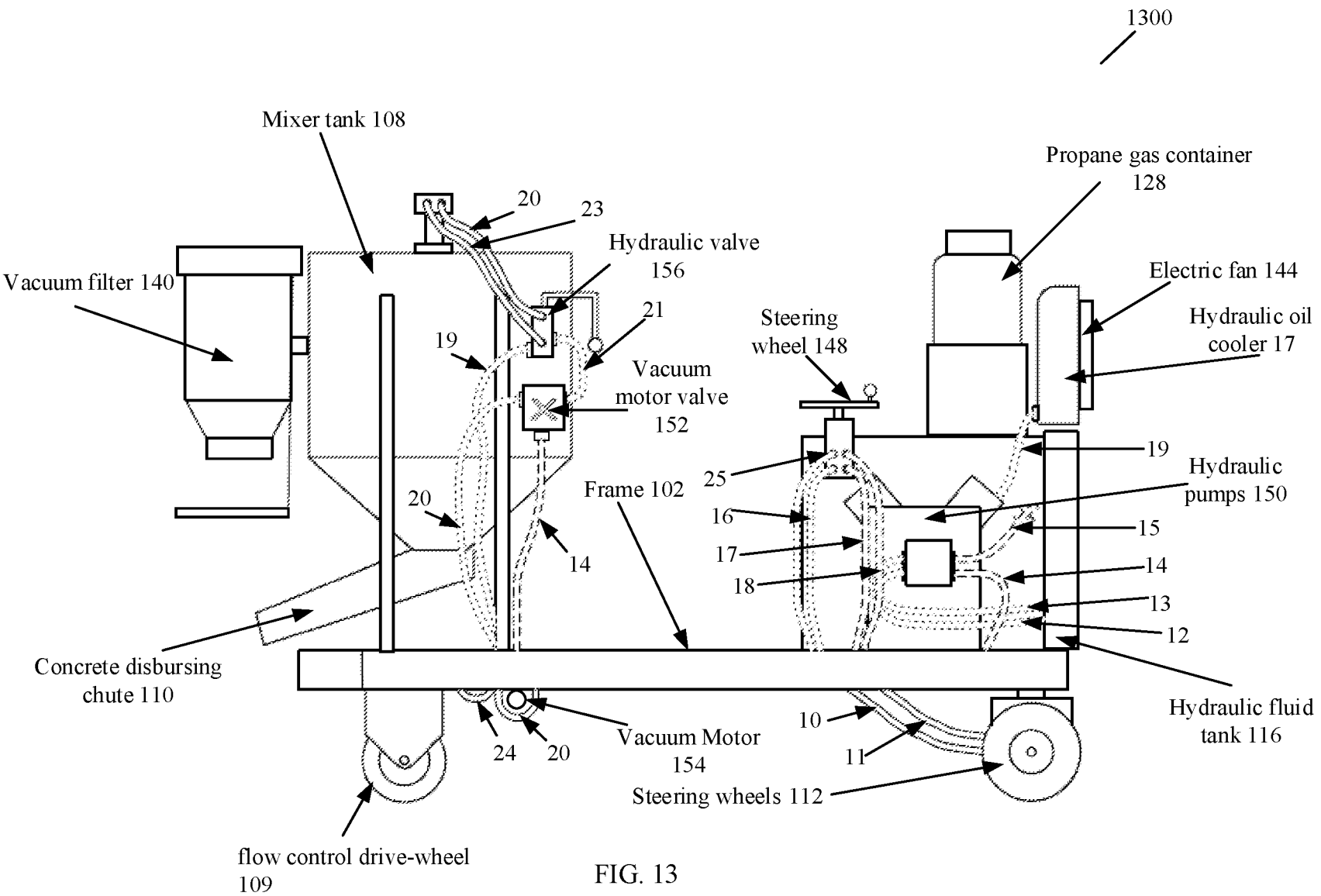

FIG. 13 is a left-side schematic view of a hydraulic control system for the concrete mixing machine of FIG. 1.

DETAILED DESCRIPTION

The present disclosure best explains the invention referring to the detailed figures and description set forth herein. The specification discusses various embodiments referring to the figures. However, those skilled in the art appreciate that the detailed descriptions provided herein concerning the figures are for explanatory purposes, as the methods and systems may extend beyond the described embodiments. For instance, the teachings presented, and the needs of a particular application may yield multiple alternative and suitable approaches to implement the functionality of any detail described herein. Therefore, any approach may extend beyond individual implementation choices in the following embodiments.

References to "one embodiment," "at least one embodiment," "an embodiment," "one example," "an example," "for example," and so on indicate that the embodiment(s) or example(s) may include a particular feature, structure, characteristic, property, element, or limitation. However, not every embodiment or example necessarily includes that particular feature, structure, characteristic, property, element, or limitation. Furthermore, repeated use of the phrase "in an embodiment" does not necessarily refer to the same embodiment.

Unless defined otherwise, all technical and scientific terms used herein have the same meaning as commonly understood by one of the ordinary skills in the art to which this invention belongs. Although one can use any method and material similar or equivalent to those described herein in the practice or testing of the present invention, the disclosure describes the preferred methods and materials. The disclosure incorporates all publications, patents, and patent applications mentioned herein in their entirety.

The use herein and in the appended claims of the singular forms "a," "and," and "the" include plural referents, unless the context dictates otherwise. In the claims, the terms "first," "second," and so forth are to be interpreted merely as ordinal designations; they shall not be limited in themselves. Furthermore, the use of exclusive terminology such as "solely," "only," and the like in connection with the recitation of any claim element is contemplated. It is also contemplated that any element indicated to be optional herein may be explicitly excluded from a given claim by way of a "negative" limitation. Finally, it is contemplated that any optional feature of the inventive variation(s) described herein may be set forth and claimed independently or in combination with any one or more of the features described herein.

All references cited herein, including publications, patent applications, and patents, are incorporated by reference to the same extent as if each reference were individually and specifically indicated to be incorporated by reference and were outlined in its entirety herein.

The recitation of ranges of values herein serves as a shorthand method of referring individually to each separate value falling within the range, unless otherwise indicated herein, and each separate value is incorporated into the specification as if recited individually.

The disclosure uses the terms concrete mixer and concrete mixing machine interchangeably and refer to the same invention and the embodiments disclosed.

FIG. 1 is a perspective view of a concrete mixing machine 100 according to a preferred embodiment of the present invention.

The concrete mixing machine 100 comprises a frame 102 comprising a mid-frame section 104. In an embodiment, the mid-frame section 104 has a platform, which in the embodiment disclosed includes a permeable lattice structure and is further referenced as a lattice platform. Other embodiments of the platform include alternative drainage or non-permeable structural members. The lattice platform provides structural support for components of the concrete mixing machine 100. The frame 102 further comprises a plurality of legs, a plurality of steering wheels 112. The plurality of wheels 112 comprise front swivel wheels and rear non-swivel wheels. In an embodiment, the structural members of concrete mixing machine 100 include 2-inch tubing, 3-inch tubing, and 2-inch by 6-inch tubing. The 2×6-inch tubing permits a forklift to support and move the concrete mixing machine 100, which is advantageous for transport and placement and removal from the machine from an indoor space.

The concrete mixing machine 100 further comprises an engine compartment 106 that houses an engine 126 mounted on the lattice platform. In an embodiment, the engine 126 comprises a propane gas container 128, a vacuum generator. In an embodiment, the engine attaches to a hydraulic drive pump driven by the engine 126 and the engine mounts on a mount-support across the frame 102. In an embodiment, the engine compartment 106 houses the engine 126. The engine compartment further includes a filter for hydraulic fluid, a mounting member across the frame to support the engine and a hydraulic pump that is driven by the engine 126. Also housed at least partially in the engine compartment are a battery, a plurality of hoses 118, a catalytic muffler for exhaust, an air filter, a hydraulic lift cylinder behind the engine, with through frame member, propane regulator between engine and frame side, and an A-frame—supports hydraulic lift cylinder. In an embodiment, the engine 126 further comprises a drive pump. In an embodiment, the propane gas container further includes a fuel line to a regulator.

The concrete mixing machine 100 further comprises the plurality of hoses 118 attached to the engine 126. In an embodiment, the plurality of hoses includes a hydraulic fluid in-hose, hydraulic fluid out-hose, and backflow in recycle-hose for fluid. The concrete mixing machine 100 further comprises a mixing assembly comprising a mixer tank 108, a flow control mechanism, and a removable grate, wherein the removable grate 134 that attaches on top of the mixer tank 108. The mixer tank 108 may have a capacity of 50-150-gallons. The removable grate 134 on top of the mixer tank may catch large items.

In an embodiment, the flow control mechanism comprises a flow control mixer 111 and a flow control drive-wheel 109. The flow control mixer 111 is attached to the mixer tank 108. In an embodiment, the flow control mixer 111 regulates amount of concrete exiting through a valve 115 and a concrete disbursing chute 110 attached to the mixer tank 108. In an embodiment, the valve 115 is located in bottom of the mixer tank 108 and opens to permit passage and flow of the fluid concrete to the concrete disbursing chute 110. In an embodiment, the speed of the flow control for the flow control mixer 111 and the drive-wheel 109 synchronizes. The operator controls the speed for optimal concrete distribution. In an embodiment, the concrete disbursing chute 110 is connected at bottom of the mixer tank and the concrete disbursing chute 110 is utilized to direct the slurry concrete in one or more areas of application of the concrete. The flow control drive-wheel on the mixer tank 108 regulates and controls the flow of concrete from the mixer tank 108 to the concrete disbursing chute 110. The operator configures the flow control drive-wheel on the mixer tank to move the machine according to the regulation and control of the flow desired. The combination of speed determined by the flow control drive-wheel and the regulation of the concrete exiting the chute 110 synchronizes to disburse the correct amount of the mixture of concrete slurry 114.

The concrete mixing machine 100 further comprises a hydraulic system comprising a filter for hydraulic fluid, a battery, one or more hydraulic hoses, a catalytic muffler for exhaust, and an air filter. The concrete mixing machine 100 further comprises a plurality of steering wheels 112 configured to direct the movement of the concrete mixing machine 100. In an embodiment, the plurality of steering wheels 112 connect to the frame 102. The steering wheels include one or more with hydraulic motors 113 attached to propel the machine. The combination of a speech controlled hydraulic motor 113 and a steering wheel from the plurality of steering wheels 112 comprise an embodiment of the flow control drive-wheel.

In an embodiment, the plurality of steering wheels 112 comprises a set of front swivel wheels and a set of rear non-swivel wheels. In an embodiment, the set of front swivel wheels attach to the front of the frame and rotate to swivel and change direction, and the set of rear non-swivel wheels attach to the rear of the frame.

The concrete mixing machine 100 further comprises a shaft 122 disposed inside the mixer tank 108, and the shaft 122 is attached to a plurality of mixing propellers 120. In an embodiment, a structural member 124 on top of the mixer tank 108 supports a hydraulic propeller drive motor 136. The hydraulic propeller drive motor rotationally moves the shaft 122. The shaft attaches to the plurality of mixing propellers 120. Structural members of the concrete mixing apparatus include 2" tubing, and a 3" tubing. The 2"×6" tubing allows lifting of concrete mixing machine 100 by a forklift. The 3"×5" tubing is under the mixer tank 108.

In the embodiment, the top mixing propeller is a 14-inch diameter propeller, and the middle mixing propeller is a 12-inch diameter. In an embodiment, the hydraulic propeller drive motor 136 connects to the shaft 122 disposed inside the mixer tank, and the hydraulic propeller drive motor 136 rotationally moves the shaft attached to the plurality of mixing propellers 120. In an embodiment, the plurality of mixing propellers connect toward a top end of the shaft near the propeller drive motor and to the mid-section of the shaft within the mixer tank.

The concrete mixing machine 100 further comprises a control stick for steering the concrete mixing machine 100 either in forward or reverse direction. The concrete mixing machine 100 further comprises a hydraulic lift cylinder disposed on a rear side of the engine 126 with a through frame member, and an A-frame supports the hydraulic lift cylinder. The concrete mixing machine 100 further comprises one or more propane regulators configured to control the flow of propane gas, and the fuel line propane regulators connect to the propane tank/propane gas container 128, and one or more propane regulators connect between the engine 126 and the frame side.

The concrete mixing machine 100 further comprises a vacuum 146 that connects externally to a pipe on top of the mixer tank 108, and the vacuum operates to collect dust generated by the mixing process for the material. The concrete mixing machine 100 further comprises a hydraulically operated fluid tank 116, a vacuum motor 154, a vacuum motor valve 152, a steering wheel 148, a hydraulic oil cooler 17 connected to an electric fan 144 and a plurality of hydraulic controls comprising a priority valve 138. In an embodiment, the concrete mixing machine 100 is hydraulically operated and self-propelled.

FIG. 2 is a partial perspective view 200 of the concrete mixing machine 100 of FIG. 1 showing a section including a mixer tank 108 and a mid-section lattice platform 104. FIG. 2 further shows the steering wheels 112.

FIG. 3 is a front view 300 of the concrete mixing machine 100 of FIG. 1 showing the hydraulic fluid tank 116, steering wheels 112, and other aspects of the invention. The hydraulic fluid tank 116 further comprises a cap, tank and the hydraulic fluid tank 116 is attached to the frame 102 using bolts.

FIG. 4 is a partial view 400 of the concrete mixing machine 100 of FIG. 1 showing a section including the interior of a mixer tank 108 and shaft 122 with mixing propellers 120. In an embodiment, a structural member 124 on top of the mixer tank supports a propeller drive motor that rotationally moves the shaft attached to the plurality of mixing propellers. In an embodiment, the structural members 124 of concrete mixing machine 100 include 2-inch tubing, 3-inch tubing, and 2-inch by 6-inch tubing. The 2×6-inch tubing permits a forklift to support and move the concrete mixing machine 100, which is advantageous for transport and placement and removal from the machine from an indoor space.

FIG. 5 is a partial right-side view 500 of the concrete mixing machine 100 of FIG. 1 showing an engine compartment that houses an engine 126 with propane gas container 128, wheels 112, vacuum, and mid-section lattice deck 104.

FIG. 6 is a partial left-side view 600 of the concrete mixing machine 100 of FIG. 1 showing a mixer tank 108, concrete disbursing chute 110, hydraulic controls 130, and mid-section lattice deck 104. Further, a plurality of hoses 118, as depicted in FIG. 6 are attached to the engine 126, and the plurality of hoses 118 comprise a hydraulic fluid in-hose, hydraulic fluid out-hose, and backflow in recycle-hose for fluid.

FIG. 7 is a partial right-side view 700 of the concrete mixing machine 100 of FIG. 1 showing a mixer tank 108, concrete disbursing chute 110, hydraulic controls 130, vacuum, and mid-section lattice deck 104.

FIG. 8 is a partial perspective view 800 of a joint for a wheel of the concrete mixing machine of FIG. 1. The joint 132 for the wheel fixes the plurality of wheels to the frame 102 of the concrete mixing machine 100.

FIG. 9 is a partial top view 900 of the concrete mixing machine 100 of FIG. 1 showing a mixer tank 108, vacuum, hydraulic controls 130, hydraulic propeller drive motor 136 for a mixer shaft 122, and a removable grate 134.

FIG. 10 is a partial schematic view 1000 of a hydraulic control system for the concrete mixing machine of FIG. 1. The Sun C'Bal valve assembly 1000 comprises of Hydraulic hose into v1 (denoted by 3), Hydraulic hose into v2 (denoted by 4), Hydraulic hose out to forward on right wheel motor (denoted by 6), Hydraulic hose out to reverse on right wheel motor (denoted by 7,) Hydraulic hose into inline T (denoted by 8,) Hydraulic hose into Posi Trac valve (denoted by 9), Hydraulic hose out to forward on left wheel motor (denoted by 10), Hydraulic hose out to reverse on left wheel motor (denoted by 11).

FIG. 11 is a partial schematic view 1100 of a priority valve 138 of a hydraulic control system for the concrete mixing machine 100 of FIG. 1. The priority valve 138 connects to four hoses. The four hoses comprise a hydraulic hose left (denoted by 5), a hydraulic hose right (denoted by 16), a hydraulic hose top (denoted by 26), and a hydraulic hose bottom (denoted by 15).

FIG. 12 is a right-side schematic view 1200 of a hydraulic control system for the concrete mixing machine 100 of FIG. 1.

Apart from the components disclosed and described hereinabove, FIG. 12 discloses a hydraulic hose (denoted by 2), a hydraulic hose into v1 of Sun C'Bal valve assembly (denoted by 3), a hydraulic hose into v2 of Sun C'Bal valve assembly (denoted by 4), a hydraulic hose left—priority valve (denoted by 5), a hydraulic hose out to forward on right wheel motor (denoted by 6), and a hydraulic hose out to reverse on right wheel motor (denoted by 7). The hydraulic control system further includes a hydraulic hose into inline T and a hydraulic hose into a valve, which may include the valve known in the industry as a positrac valve.

FIG. 12 further depicts the vacuum 146, the hydraulic fluid tank 116, the hydraulic oil cooler 17, electric fan 144, the propane gas container 128, the frame 102, the engine compartment 106, the propeller drive motor 136, the mixer tank 108, the vacuum filter 140, the vacuum hose 142, the concrete disbursing chute 110, and the plurality of steering wheels 112.

FIG. 13 is a left-side schematic view 1300 of a hydraulic control system for the concrete mixing machine 100 of FIG. 1. The hydraulic control system for the concrete mixing machine 100 comprises a hydraulic hose out to forward on left wheel motor (denoted by 10), a hydraulic hose out to reverse on left wheel motor (denoted by 11), a hydraulic hose between hydraulic tank and pump (denoted by 12), a hydraulic hose between hydraulic tank and pump (denoted by 13), a hydraulic hose between pump and vacuum motor drive (denoted by 14), a hydraulic hose bottom priority valve (denoted by 15), a hydraulic hose right priority valve (denoted by 16), a connection to steering wheel (denoted by 17), a connection to steering wheel (denoted by 18), a hydraulic hose between hydraulic valve and hydraulic oil cooler (denoted by 19), a hydraulic hose between vacuum motor valve and vacuum motor (denoted by 20), a hydraulic hose between hydraulic valve and vacuum motor valve (denoted by 21), a connection between hydraulic valve and mixer motor (denoted by 22), a connection between hydraulic valve and mixer motor (denoted by 23), a hydraulic hose at vacuum motor (denoted by 24), a hydraulic hose at steering wheel (denoted by 25) and a hydraulic hose top—priority valve (denoted by 26)

FIG. 13 further depicts the vacuum motor 154, the hydraulic fluid tank 116, the hydraulic oil cooler 17, electric fan 144, the propane gas container 128, the frame 102, the mixer tank 108, the vacuum filter 140, the hydraulic valve 156, the vacuum motor valve 152, the steering wheel 148, the concrete disbursing chute 110, and the plurality of steering wheels 112.

While the summary and detailed description show and describe preferred embodiments of the present invention, those skilled in the art recognize those embodiments as examples. The specification does not limit the invention by the specific examples provided. Instead, those skilled in the art recognize variations, changes, and substitutions without departing from the invention. Furthermore, all aspects of the invention are not limited to the specific depictions, configurations, or relative proportions set forth herein, which depend upon a variety of conditions and variables. The inventor contemplates that the invention shall cover alternatives, modifications, variations, or equivalents.

ADVANTAGES

The disclosed concrete mixing machine 100 provides an environment-friendly concrete mixing machine that improves efficiency installing concrete based floors inside of buildings. The concrete mixing machine 100 increases the quantity and efficiency of concrete mixed indoors while meeting environmental requirements. The disclosed concrete mixing machine 100 may generate 23 bags of concrete with less labor-intensive process.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise. The terms "including", "comprising", "having" and variations thereof mean "including but not limited to", unless expressly specified otherwise. The terms "a", "an" and "the" mean "one or more", unless expressly specified otherwise.

No language in the specification should be construed as indicating any non-claimed element as essential to the practice of the invention. A description of an embodiment with several components in communication with each other does not imply that all such components are required. On the contrary, a variety of optional components are described to illustrate the wide variety of possible embodiments of the invention.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit indicated by the following claims.

A person with ordinary skills in the art will appreciate that the systems, components, and sub-components have been illustrated and explained to serve as examples and should not be considered limiting in any manner. It will be further appreciated that the variants of the above-disclosed system elements, components, and sub-components, and other features and functions, or alternatives thereof, may be combined to create other different systems or applications.

Those skilled in the art will appreciate that any of the steps mentioned above or system modules may be suitably replaced, reordered, or removed, and additional steps or elements, components, and sub-components may be inserted, depending on the needs of a particular application.

While the present disclosure has been described with reference to particular embodiments, it will be understood by those skilled in the art that various changes may be made, and equivalents may be substituted without departing from the scope of the present disclosure. Also, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

I claim:

1. A concrete mixing machine, the machine comprising:

a frame comprising a mid-frame section, wherein the mid-frame section has a platform and provides structural support for components of the concrete mixer;

an engine compartment that houses an engine mounted on the platform, wherein the engine comprises a propane gas container, a vacuum generator, wherein the engine is attached to a hydraulic drive pump driven by the engine, and wherein the engine mounts on a mount support across the frame;

a plurality of hoses attached to the engine, wherein the plurality of hoses comprise a hydraulic fluid in-hose, hydraulic fluid out-hose, and backflow in recycle-hose for fluid;

a mixing assembly comprising a mixer tank, and a flow control mechanism, wherein the flow control mechanism comprises:

a valve attached to the mixer tank, wherein a hydraulic control regulates an amount of concrete exiting through the valve and a concrete disbursing chute attached to the mixer tank, wherein the valve is located in a bottom of the mixer tank and opens to permit passage and flow of the fluid concrete to the concrete disbursing chute, wherein the concrete disbursing chute connects about the bottom of the mixer tank, and wherein the concrete disbursing chute is utilized to direct the slurry concrete in one or more areas of application;

a hydraulic system comprising a filter for a hydraulic fluid, a battery, one or more hydraulic hoses, a catalytic muffler for exhaust, and an air filter;

a plurality of steering wheels and at least one drive-wheel configured to direct movement of the concrete mixing machine, wherein the plurality of steering wheels and the at least one drive-wheel connect to the frame;

a shaft disposed inside the mixer tank, wherein the shaft is attached to a plurality of mixing propellers, wherein a structural member on top of the mixer tank supports a propeller drive motor that is configured to rotationally move the shaft attached with the plurality of mixing propellers; and the propeller drive motor connected to the shaft disposed inside the mixer tank, wherein the the propeller drive motor is configured to rotationally move the shaft attached with the plurality of mixing propellers.

2. The concrete mixing machine of claim 1, further comprising a hydraulic lift cylinder disposed on a rear side of the engine with a through frame member, wherein an A-frame supports the hydraulic lift cylinder.

3. The concrete mixing machine of claim 1, further comprising one or more propane regulators configured to control flow of propane gas.

4. The concrete mixing machine of claim 1, wherein the plurality of steering wheels comprise a set of front swivel wheels and the at least one drive-wheel comprises a set of rear non-swivel wheels, wherein the set of front swivel wheels attach to the front of the frame and rotate to swivel and change direction, wherein the set of rear non-swivel wheels attach to the rear of the frame.

5. The concrete mixing machine of claim 1, wherein said drive-wheel and the passage and flow of the fluid concrete to the concrete disbursing chute regulated via the valve synchronize as controlled by an operator for optimal concrete distribution.

6. The concrete mixing machine of claim 1, wherein the plurality of mixing propellers connect toward a top end of the shaft near the propeller drive motor and to the mid-section of the shaft within the mixer tank.

7. The concrete mixing machine of claim 1, further comprising a vacuum that connects externally to a pipe on top of the mixer tank, wherein the vacuum operates via the vacuum generator of the engine to collect dust generated by the concrete mixer tank.

8. The concrete mixing machine of claim 1, further comprising a hydraulically operated fluid tank, a vacuum motor, a vacuum motor valve, a steering wheel, a hydraulic oil cooler connected to an electric fan and a plurality of hydraulic controls comprising a priority valve, wherein the concrete mixing machine is hydraulically operated and self-propelled.

9. The concrete mixing machine of claim 1, in which said mixing assembly comprising said mixer tank comprises a removable grate, wherein the removable grate attaches on top of the mixer tank.

10. The concrete mixing machine of claim 1, including a flow control drive-wheel on the mixer tank configured to regulate and control flow of concrete from the mixer tank and from the concrete disbursing chute.

* * * * *